United States Patent [19]

Kim et al.

[11] 4,370,868

[45] Feb. 1, 1983

[54] DISTRIBUTOR FOR PLATE FIN EVAPORATOR

[75] Inventors: Tong S. Kim; Yong N. Lee, both of Arlington Heights, Ill.

[73] Assignee: Borg-Warner Corporation, Chicago, Ill.

[21] Appl. No.: 222,455

[22] Filed: Jan. 5, 1981

[51] Int. Cl.[3] ..... F25B 39/02

[52] U.S. Cl. ..... 62/504; 62/515; 62/527; 165/153; 165/158

[58] Field of Search ..... 62/504, 515, 525, 527; 165/153, 158

[56] References Cited

U.S. PATENT DOCUMENTS

| | | | |
|---|---|---|---|
| 2,478,791 | 8/1949 | Swart | 62/126 |
| 2,707,868 | 5/1955 | Goodman | 62/4 |
| 2,871,679 | 2/1959 | Zearfoss, Jr. | 62/504 |
| 2,990,700 | 7/1961 | Weibert, Jr. | 62/527 |
| 3,234,755 | 2/1966 | Richelli | 62/525 |
| 3,795,259 | 3/1974 | Brandin et al. | 137/561 A |
| 3,919,858 | 11/1975 | Garland et al. | 62/498 |
| 3,922,880 | 12/1975 | Morris | 62/498 |
| 3,976,128 | 8/1976 | Patel et al. | 165/153 |
| 3,978,687 | 9/1976 | Calzadilla | 62/525 |
| 4,089,368 | 5/1978 | Bell, Jr. et al. | 165/139 |
| 4,114,397 | 9/1978 | Takahashi et al. | 62/527 |
| 4,244,194 | 1/1981 | Haesters et al. | 62/515 |

*Primary Examiner*—Ronald C. Capossela
*Attorney, Agent, or Firm*—James A. Geppert

[57] ABSTRACT

A distributor for feeding the liquid-vapor mixture of refrigerant from the expansion valve to the core elements of an evaporator of an air conditioning system to provide equal distribution of both the liquid and vapor components. The distributor involves either a single header with separate orifices for the liquid and vapor in each core element or a pair of distribution headers to carry the separated component phases from a separator with an orifice for each phase in each core element where the phases would be recombined to pass through the core elements to a common outlet.

14 Claims, 7 Drawing Figures

DISTRIBUTOR FOR PLATE FIN EVAPORATOR

BACKGROUND OF THE INVENTION

An air conditioning system conventionally includes an evaporator, a compressor, a condenser and an expansion valve or other throttling device. As the liquid-vapor refrigerant mixture flows through the evaporator, heat is absorbed from a fluid being cooled and the refrigerant boils; resulting in a low pressure vapor that is compressed and then condensed in the condenser. This liquid refrigerant flows from the condenser to the expansion valve where its pressure and temperature are reduced and the liquid-vapor mixture issuing from the valve again flows to the evaporator.

A typical evaporator of the plate-fin type consists of a number of core elements connected together in parallel, with each core element formed from a pair of dished plates providing an enclosed cavity with an inlet at one side and an outlet at the opposite side; the core elements being spaced apart to allow air flow therebetween and heat transfer fins on the exterior of the core element plates extend into the air flow path. The inlets and the outlets of the core elements are connected together to provide an elongated inlet header and an elongated outlet header, respectively, with the core elements connected in parallel. Assuming that the refrigerant supply from the expansion valve is introduced in a lower inlet header, the supply enters the evaporator as a mixture of liquid and vapor. As this mixture travels through the lower header, the vapor portion is readily deflected upward to enter the core elements, while the liquid portion tends to continue travelling straight through the header due to its greater density and most of this liquid enters the last core element in its path. Thus, the preceding core elements are substantially "starved" of liquid refrigerant, resulting in a poor overall performance of the evaporator.

The problem can be somewhat alleviated by designing wide refrigerant passages into all parts of the evaporator to reduce the refrigerant velocity sufficiently so that the evaporator can be operated with the core elements flooded with liquid refrigerant, but without the liquid being carried over by the exiting vapor refrigerant. With such a low velocity, however, the advantage of a high velocity to improve heat transfer must be given up. This would not be a very serious loss in the main part of the evaporator under current design practice, since the heat transfer in the nucleate boiling regime, without the benefit of high convection, is still adequately effective.

Since the refrigerant must be superheated to some degree for the proper functioning of the thermostatic expansion valve, the low velocity of the refrigerant results in a disproportionately large portion of the evaporator devoted to the superheating section owing to the poor refrigerant heat transfer in this section. If the design practice changes to add more heat transfer area on the air-side, as would be desirable, the need to improve the refrigerant-side heat transfer, even in the main evaporating section, would intensify. Moreover, with the flooded condition of the evaporator, the quantity of refrigerant in the air conditioning system would appear to be critical. If there is too little refrigerant, the evaporator performance would suffer and, with too much, the liquid is likely to slug over into the compressor.

An alternative solution to the refrigerant distribution problem would be to connect the core elements in series rather than in parallel; however, such a construction may result in a high pressure drop in the evaporator due to the numerous reversals of the refrigerant flow direction at the ends of the core elements. This drawback will become most serious when the evaporator is designed for a high refrigerant velocity to improve the heat transfer.

A more serious problem, however, is that more core elements cannot simply be added to produce an evaporator of greater capacity. The simple addition of core elements would result in a rapid increase in the pressure drop due to the increase in the refrigerant flow rate through a given core element and the increase in the refrigerant path length. To reduce the pressure drop, the cross sectional area of the core element cavity must be increased. This means that, for optimum performance, an evaporator of each given capacity must be made from plates specifically designed for that particular capacity requiring one specific stamping die. Thus, the cost of tooling and inventory would be high.

The present invention overcomes the above enumerated problems of distribution of the refrigerant liquid-vapor mixture in parallel connected elements of a plate-fin evaporator.

SUMMARY OF THE INVENTION

The present invention comprehends the provision of a novel evaporator construction for use in an air conditioning system which will inject the liquid portion and vapor portion of the refrigerant from the expansion valve separately into each core element connected in parallel to form the evaporator. The refrigerant supply may be carried in a single header or in two separate headers with a liquid orifice and a vapor orifice for each core element; the liquid and vapor phases being recombined in each core element to pass through the core element cavity to a refrigerant outlet header.

The present invention also comprehends the provision of a novel evaporator construction having a single header for the liquid-vapor mixture of refrigerant and wherein each core element has an upwardly directed orifice from the header for the vapor phase and a downwardly directed orifice from the header for the liquid phase. These orifices will effectively distribute both liquid and vapor phases of refrigerant where the inlet header is either at the upper or lower end of the evaporator.

The present invention further comprehends the provision of a novel evaporator construction wherein two separate headers are provided on the inlet side of the evaporator for separate flow of the liquid phase and the vapor phase of the refrigerant. Each header has an orifice opening into each core element for equal distribution of the liquid and vapor phases. Once in the main core area of each element, the vapor and liquid phases are recombined to pass through the core cavity to the outlet header.

The present invention also relates to a novel evaporator construction wherein each core element has a multi-pass arrangement from the inlet headers to the outlet header with a practical gap for flow of refrigerant. Also, the multi-pass arrangement allows both the inlet and outlet headers to be located at the same end of the core elements to provide a more compact design of the evaporator passage and easier installation in the duct.

Further objects are to provide a construction of maximum simplicity, efficiency, economy and ease of assembly and operation, and such further objects, advantages and capabilities as will later more fully appear and are inherently possessed thereby.

DESCRIPTION OF THE PREFERRED EMBODIMENTS

Figure 1:
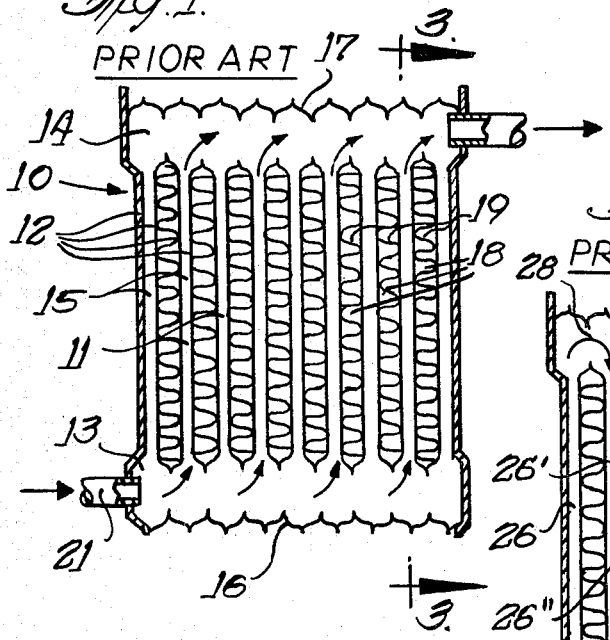
Fig. 1. PRIOR ART
FIG. 1 is a cross sectional view through a conventional parallel flow evaporator of the plate-fin type for an air conditioning system.

Referring more particularly to the disclosure in the drawings wherein are shown illustrative embodiments of the present invention, FIG. 1 discloses a conventional evaporator 10 utilized in an air conditioning system (not shown) including a compressor, a condenser and an expansion valve. The evaporator is formed from a plurality of core elements 11; each core element being formed from a pair of oppositely dished plates 12, 12 defining an inlet passage 13, an outlet passage 14 and a central heat transfer cavity 15. The aligned inlet passages 13 form an elongated inlet header 16, while the aligned outlet passages 14 form an elongated outlet header 17. The core elements are joined at their opposite ends to form the headers but are spaced apart in the central core cavity area to provide flow spaces 18 for a second fluid, such as air, to be cooled. Air side fins 19 are located in the spaces 18 to enhance the heat transfer from the air or other fluid to the refrigerant liquid-vapor mixture passing through the evaporator.

In the design of FIG. 1, a liquid-vapor mixture of refrigerant from the expansion valve (not shown) enters the inlet 21 for the evaporator 10 into the inlet header 16. As this mixture enters the header, the vapor portion is readily deflected upwardly to enter the core elements 11; however, the liquid portion, because of its greater density, tends to travel straight through the header 16 and most of it enters the last core element at the right-hand end of FIG. 1. Thus, the preceding core elements 11 at the left-hand end and center of FIG. 1 are substantially "starved" of liquid refrigerant resulting in a poor overall performance of the evaporator.

Figure 2:
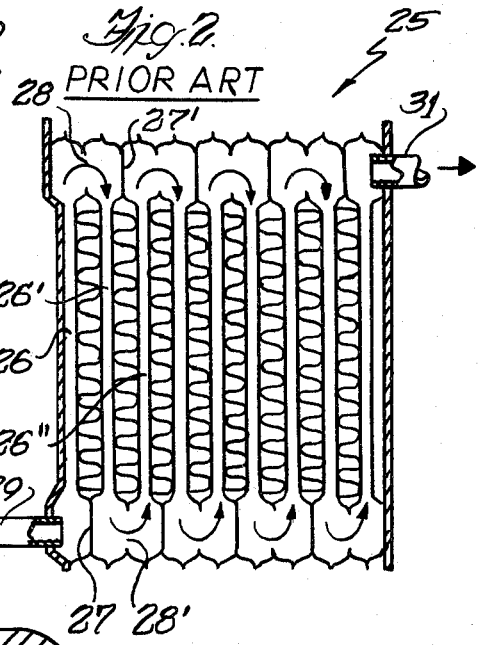
Fig. 2. PRIOR ART
FIG. 2 is a cross sectional view of an evaporator similar to FIG. 1, but showing a series flow path.

FIG. 2 discloses an evaporator 25 wherein the core elements 26 are connected in series. In this embodiment, the first core element 26 is closed at 27 at the inlet side but open at 28 on the outlet side. The second core element 26′ is closed at 27′ at the outlet side but open at 28′ at the inlet side. Thus, the refrigerant mixture enters the evaporator at inlet 29 and travels upward through core element 26 and opening 28 to then move downward through core element 26′ and opening 28′. At each end the refrigerant path makes a U-turn and sequentially moves through the core elements 26,26′, 26″, etc. to the outlet 31. This arrangement has the disadvantage of a high pressure drop due to the reversals of the refrigerant flow direction at the ends of the core elements and the great length of the flow path; which will be most serious where the evaporator is designed for a high refrigerant velocity to improve the heat transfer.

Figure 3:
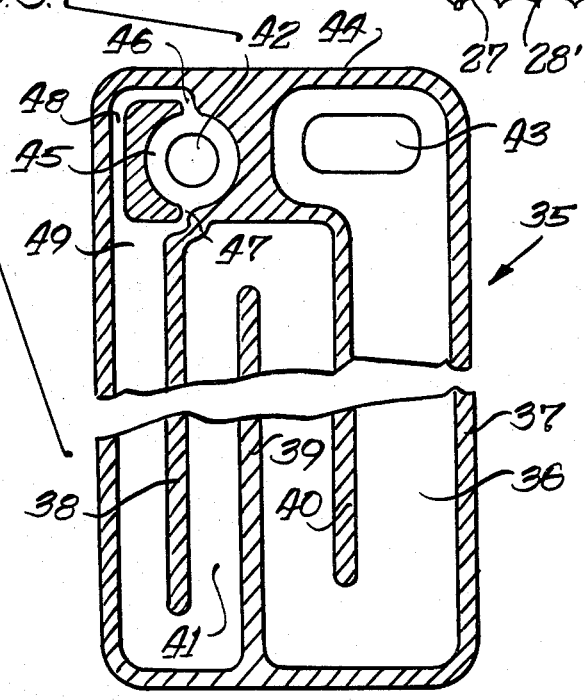
FIG. 3 is a cross sectional view taken on a line 3—3 of FIG. 1 but showing one version of an improved evaporator core element.

To solve these various problems, a revised core element 35 is shown in cross section in FIG. 3 which will overcome the liquid-vapor mixture distribution problems. The core elements are formed of generally oppositely dished plates 36 having a reconstruction of the header and core cavity space. The core section is taken on a line at a position similar to the line 3—3 of FIG. 1 through its mid-plane parallel to its flat side. The plates are dished at the outer edges 37 to be joined by soldering or brazing and have internal ribs or walls 38, 39, 40 that are joined to corresponding walls of the opposite plate to form a sinuous fluid path 41 through the core cavity. Each plate has an inlet opening 42 and an outlet opening 43 which may be positioned at the same end 44 of the plate to provide a more compact design of the evaporator package.

An inlet header 45 connects the inlet openings 42 of the parallel core elements 35 and, for each core element 35, the header provides an upwardly directed orifice 46 for the vapor phase of the refrigerant and a downwardly opening orifice 47 for the refrigerant liquid phase. This header, in effect, separates the liquid and vapor phases of the refrigerant mixture from the expansion valve to provide a substantially equal distribution in each core element 35 arranged in parallel in the evaporator. The vapor phase flows through a restricted passage 48 to recombine with the liquid phase at the beginning 49 of the sinuous passage 41 through the core element.

The orifices 46 and 47 for the vapor and liquid phases are of approximately equal size, and the disturbance through the "bellows-like" header 45 caused by the joining of the plates 36 of each core element 35 appears to help improve the refrigerant distribution; especially in the case of downfeed of the refrigerant as seen in FIG. 3, as opposed to an upfeed as is common to conventional plate-fin evaporators. As to the free-flow cross-sectional area through the header, it has been found that the smaller the area, the more effective is the uniform liquid distruction. With a sufficiently small area or, alternatively, with a high enough refrigerant flow, it appears that vapor vents for vapor formed in the liquid due to flashing may even be obviated for downward flow. However, the area must not be so small as to result in an excessive pressure drop of refrigerant flow through the header.

Moreover, if the same plate is to be used for evaporators of different capacities by assembling the required number of core elements, the flow area in the header must be sized properly for maximum capacity. Under this arrangement, an evaporator with a lower capacity would have a relatively oversized header, and vapor vents would be necessary to assure uniform distribution of the refrigerant supply. For the same reason, the use of vapor vents will improve the part-load efficiency of the evaporator with a properly sized header.

The above concepts will work for the arrangement shown in FIG. 3 where the liquid phase is fed downward; however, if this evaporator is to be installed in an inverted orientation, the vapor orifice and the liquid orifice will simply interchange their roles. On the other hand, where the evaporator is to be installed in a position rotated 90° from that shown in FIG. 3, the plate must then be redesigned to relocate the orifices to achieve proper separation of the liquid and vapor phases.

Figure 4:
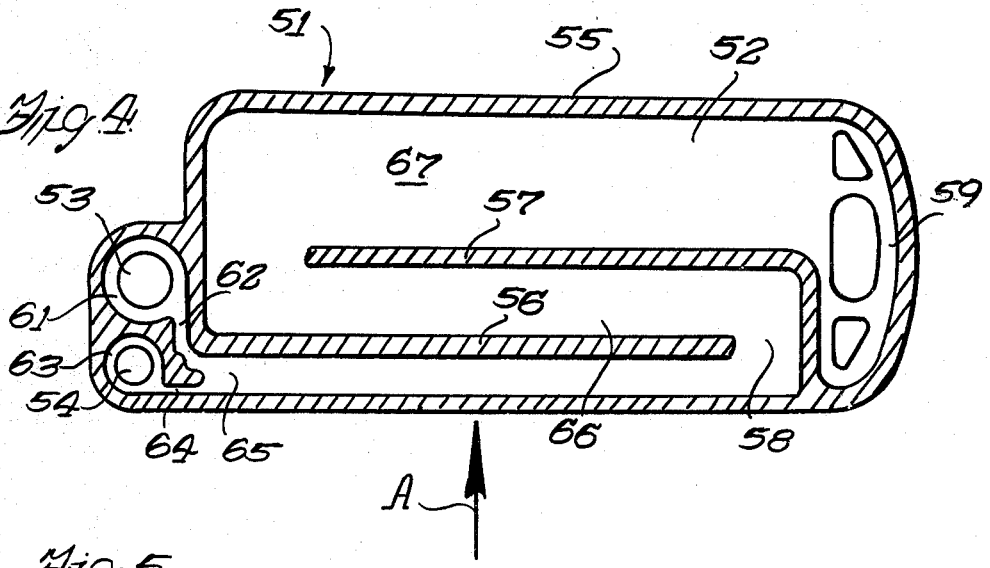
FIG. 4 is a cross sectional view similar to FIG. 3, but showing an alternate version of improved evaporator core element.
Figure 5:
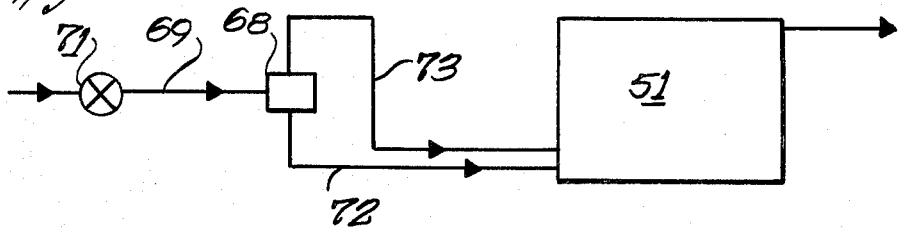
FIG. 5 is a schematic showing of a portion of the flow circuit for the evaporator of FIG. 4.

FIG. 4 discloses an alternate version of evaporator plate 52 for a core element 51 wherein the refrigerant supply header area is provided with two separate inlet openings 53 and 54. These two openings are for the separate injection of the liquid and vapor phases of the refrigerant mixture from the expansion valve, which component phases are divided by a separator 68 inserted in the line 69 from the expansion valve 71 as seen in FIG. 5. With reference to FIG. 4, each dished plate has an edge area 55 joined to the corresponding edge of a facing plate, and flow directing walls 56 and 57 providing a sinuous flow path 58 in the core cavity to the outlet header 59. A vapor supply header 61 communicates with the openings 53 with a vapor orifice 62 formed in each core element, while a liquid supply header 63 communicates with the openings 54 with a liquid orifice 64 in each core element. The liquid and vapor phases passing through the orifices 62 and 64 recombine at the beginning 65 of the fluid flow path 58 in the core cavity.

It should be noted that the sinuous flow path has an initial small cross sectional area in the beginning portion 65, with the second pass 66 of a greater area and the third pass 67 of an even greater area. This change in area in the serpentine path acts to optimize the refrigerant flow velocity and improve the convective boiling heat transfer coefficient, but keeping within bounds the refrigerant pressure drop and the resulting reduction in the temperature difference between the outside air and refrigerant. This concept of an enlarging flow passage would also apply to the arrangement of core elements 35 shown in FIG. 3. Since the apparent density of the liquid-vapor mixture changes as evaporation progresses, optimizing the velocity means that the flow cross-sectional area must be varied along the refrigerant path as shown at 65, 66 and 67. Also, the multi-pass arrangement allows the core element to be designed with a practical gap between the pair of plates.

Another benefit of this construction relates to its heat transfer characteristics. With reference to FIG. 4, the refrigerant near the lower edge of the core elements 51 is warmer than near the upper edge thereof since the refrigerant pressure drops as it flows due to friction, and the corresponding saturation temperature falls. Now with the air flow in the direction of the arrow A on the outside of the core elements, the resulting temperature distributions of the air and refrigerant are similar to those in a counterflow heat exchanger for sensible heat exchange. Such a heat exchanger is more efficient than parallel-flow or cross-flow heat exchangers.

The benefit accrues from the fact that, with this arrangement, the warmest refrigerant is in thermal contact with the warmest air though mechanically separated by the evaporator wall. Thus, if the refrigerant vapor is required to leave the evaporator at a much higher temperature than the incoming refrigerant, as in certain applications calling for high superheat, then the opposite arrangement would be preferable. In any case, the present invention allows arranging of the flow directions to suite the application and still achieve the most effective heat transfer. This is not possible with conventional plate-fin evaporators which are of the cross-flow type of heat exchangers.

Although shown at opposite ends, the inlet headers 61, 63 and outlet header 59 in the structure of FIG. 4 could be located at the same end of the core element 51, in the same manner as shown in FIG. 3. Moreover, the advantages presented in the preceding two paragraphs applies to that version also.

Figure 6:
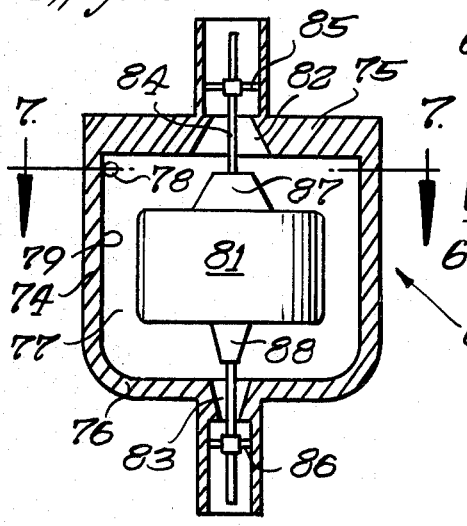
FIG. 6 is a cross sectional view of a liquid-vapor separator taken on the line 6—6 of FIG. 7 with the float shown in elevation and used in the flow circuit of FIG. 5.
Figure 7:
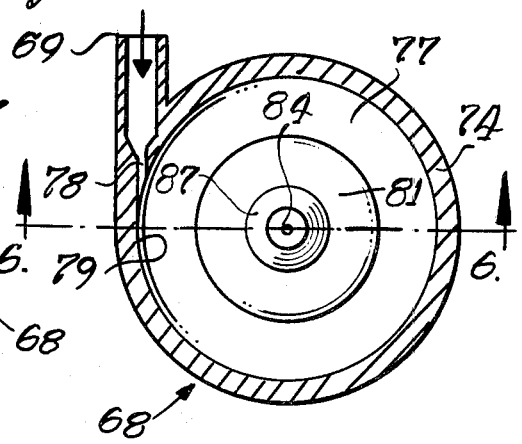
FIG. 7 is a cross sectional view of the separator taken on line 7—7 of FIG. 6.

With reference to FIG. 5, the separator 68 in line 69 feeds the liquid phase and vapor phase to separate conduits 72 and 73 leading to the liquid phase header 63 and the vapor phase header 61. One construction of separator 68 shown in FIGS. 6 and 7 includes a generally cylindrical housing 74 with a flat top wall 75 and a dished bottom wall 76 to form a chamber 77. The liquid-vapor mixture is introduced from line 69 in the form of a jet through a nozzle 78 in a direction tangent to the wall 79 of the chamber. A float 81 acting as a valve for a vapor port 82 in the top wall 75 and a liquid port 83 in the bottom wall 76 is mounted on a reciprocable valve stem 84 having an upper centering spider 85 in port 82 and a lower centering spider 86 in port 83.

The float 79 is provided with an upper conical surface 87 complementary to the port 82 and a lower conical surface 88 complementary to the port 83. The conical surfaces need not provide a complete closure of either port, but only serve to restrict the ports. The principle of centrifugal separation is utilized to effectively separate the liquid and vapor phases in a small space, and the separation need not be perfect as small vapor bubbles trapped in the liquid and liquid drops suspended in the vapor in the form of fine mist are not expected to affect the effectiveness of the present invention. The separated liquid and vapor phases will leave through the ports 83 and 82, respectively.

If the liquid conduit 72 is relatively large so that the pressure drop in that line is less than the vapor line pressure drop under given supply rates for the vapor and liquid; then the liquid will leave the chamber 77 at a faster rate than the supply from the expansion valve until the chamber is drained of substantially all liquid, if any liquid was present at the start of separation. Subsequently, some of the vapor will enter the liquid line if the float were not present; however, the float 81 acts as a valve in the separator such that if the liquid line flow resistance is too low, the falling liquid level allows the float to restrict the liquid port and the vapor port is opened wider. An imbalance in the other direction will cause the float to rise. Obviously, it is desirable to design the liquid and vapor lines to balance the pressure drops without the aid of the float; however, it is unlikely that the balance can be preserved over a wide range of operating conditions to which the evaporator is subjected. Thus, the necessity for the float. An alternative way of keeping the float concentric in the chamber would be to mount the float on a coil spring which, in turn, is fixed to the chamber.

A plate-fin evaporator of conventional design operates normally with the core elements flooded with liquid refrigerant which is fed upwardly at a very low velocity. This causes lubricating oil carried by the refrigerant to accumulate in the evaporator. Although provision is usually made to bleed oil from the bottom of the evaporator and return it to the compressor, it is ineffective. Since the oil is in solution in the liquid refrigerant, refrigerant will be bled along with the oil which means the oil can only be bled very slowly to return only the essential minimum of oil to the compressor and leaving a high concentration of oil in the evaporator. The conventional evaporator operates basically in the nucleate boiling regime owing to the low refrigerant velocity, and the heat transfer in this regime is believed to be seriously degraded by a high concentration of oil. With the present invention, the oil will be entrained in the high velocity vapor and carried to the compressor eliminating the problem of oil return, and the oil concentration in the evaporator is greatly reduced.

A core element 35 or 51 of the construction of the present invention is, by itself, essentially a full-fledged evaporator of sophisticated design, and any number of these core elements can be connected in parallel to make up an evaporator of desired capacity without any concern for pressure drop and refrigerant distribution. This will greatly reduce the costs of engineering, tooling and inventory.

We claim:

1. An evaporator for an air conditioning system receiving a liquid-vapor mixture of refrigerant from an expansion valve and comprising a plurality of core elements arranged in parallel, each core element formed from a pair of oppositely dished plates joined at the edges and defining an inlet, an outlet and a core cavity connecting the inlet and outlet, the improvement comprising at least one inlet header defined by the inlet openings of the core elements receiving the liquid-vapor refrigerant mixture, an outlet header defined by the outlet openings, a liquid supply orifice from said inlet header to the core cavity of each core element, and a separate vapor supply orifice from said inlet header to the core cavity of each core element to provide an equal distribution of refrigerant liquid and vapor from said header to each of said core elements.

2. An evaporator as set forth in claim 1, wherein said inlet header and said outlet header are at opposite ends of the core elements.

3. An evaporator as set forth in claim 1, wherein said inlet header and said outlet header are located at the same end of the core elements.

4. An evaporator as set forth in claim 1, in which internal walls in each core cavity provide a serpentine path for said refrigerant between said inlet and outlet headers.

5. An evaporator as set forth in claim 4, wherein said serpentine path gradually increases in area between said inlet header and said outlet header.

6. An evaporator as set forth in claim 1, wherein the liquid and the vapor from their respective orifices are recombined at the beginning of the core cavity.

7. An evaporator as set forth in claim 6, wherein the liquid supply orifice and vapor supply orifice both communicate with a single inlet header.

8. An evaporator as set forth in claim 7, in which said vapor supply orifice is upwardly directed from the inlet header and the liquid supply orifice is downwardly directed.

9. An evaporator as set forth in claim 6, in which a pair of inlet headers are provided for the core elements, one header receiving only the liquid supply and the other header receiving only the vapor supply from the expansion valve.

10. An evaporator as set forth in claim 9, including a liquid-vapor separator receiving the liquid-vapor mixture from the expansion valve, and a liquid conduit and a vapor conduit leading from the separator to said respective pair of inlet headers.

11. An evaporator as set forth in claim 9, in which said inlet headers are separate and parallel, a liquid supply orifice from said liquid supply header for each core element, and a vapor supply orifice from said vapor supply header for each core element.

12. An evaporator as set forth in claim 6, in which air flow between said core elements is transverse to the general refrigerant flow in the core cavity.

13. An evaporator as set forth in claim 12, in which the air flow enters the core at the edge of the core elements adjacent the inlet header to provide a counterflow heat transfer exchange.

14. An evaporator as set forth in claim 12, in which the air flow enters the core at the edge of the core elements adjacent the outlet header where a high superheat is required for the refrigerant.

* * * * *